US006119322A

United States Patent [19]

Eto

[11] Patent Number: 6,119,322

[45] Date of Patent: Sep. 19, 2000

[54] CASED COIL SPRING PRODUCING APPARATUS

[75] Inventor: Hiroyuki Eto, Kawasaki, Japan

[73] Assignee: Matsushita Industrial Co., Ltd., Osaka, Japan

[21] Appl. No.: 09/223,714

[22] Filed: Dec. 31, 1998

[30] Foreign Application Priority Data

Jun. 26, 1998 [JP] Japan ..... 10-181077

[51] Int. Cl.[7] ..... B65B 9/06

[52] U.S. Cl. ..... 29/33 E; 29/33 K; 53/114; 53/450

[58] Field of Search ..... 29/33 E, 33 R, 29/33 K, 91.1; 53/114, 450; 72/132, 135, 137, 138

[56] References Cited

U.S. PATENT DOCUMENTS

| | | | |
|---|---|---|---|
| 2,032,510 | 3/1936 | Spühl . | |
| 5,259,226 | 11/1993 | Itaya . | |
| 5,572,853 | 11/1996 | St. Clair et al. | 53/450 X |
| 5,613,287 | 3/1997 | St. Clair | 29/91.1 |
| 5,740,597 | 4/1998 | Eto | 29/33 E |
| 5,761,784 | 6/1998 | Ogle et al. | 53/114 |
| 5,868,383 | 2/1999 | Codos | 53/450 X |

FOREIGN PATENT DOCUMENTS

| | | |
|---|---|---|
| 0 781 726 | 7/1997 | European Pat. Off. . |
| 9-173673 | 7/1998 | Japan . |

*Primary Examiner*—William Briggs
*Attorney, Agent, or Firm*—Wenderoth, Lind & Ponack, L.L.P.

[57] ABSTRACT

A cased coil spring producing apparatus comprises a coil spring producing mechanism for forming coil springs, a conveying mechanism including a conveyer for conveying the coil springs fed from the coil spring producing mechanism, a hardening-and-cooling mechanism for hardening the coil springs and cooling them, a sheet feeding mechanism for double folding a sheet and feeding it, a compression-and-insertion mechanism for compressing the coil springs and inserting them in the double folded sheet, a bonding mechanism for bonding the double folded sheet inserting therein the coil springs together, and a coil spring arraying mechanism for changing position of the coil springs inserted in the sheet. The conveyer of the conveying mechanism includes coil spring supporting members aligned in two or more rows rising upwardly therefrom. A sorting mechanism is provided for sortably distributing the coil springs fed from the coil spring producing mechanism to the coil spring supporting members.

24 Claims, 11 Drawing Sheets

CASED COIL SPRING PRODUCING APPARATUS

BACKGROUND OF THE INVENTION

1. Field of the Invention

The present invention relates to an apparatus for producing cased coil springs for use in mattresses and chairs which are cased in casing (bags). The casings are successively formed in a pocket form from a sheet of non-woven fabric or cloth.

2. Description of the Prior Art

A conventional type of cased coil spring producing apparatus is not equipped with any hardening device for hardening the coil springs. Thus, it has the problem of the produced coil springs being weak in resiliency and having low durability. To eliminate those problems, an expensive, oil-tempered, wire rod is used in forming the coil springs. However, since the oil-tampered wire rod has a strong resiliency, it takes much time and labor to form the oil-tempered wire rod into a coiled form. Thus, productivity is decreased and manufacturing costs of the coil springs is increased, in addition to the expensive wire rod.

The formed coil springs are put into a compressed state and then are inserted in the casings. In putting the coil springs into the compressed state for insertion, a large-stroke cylinder rod having at its tip end thereof a circular compressing plate has been generally used. The coil springs, after being placed in cylindrical guides to be in a vertical position, are each compressed with the compressing plate from above by a force of the cylinder rod and are then pushed at an outer diameter portion thereof to be inserted in the casing. This conventional method, however, involves the problem of low productivity because the feeding of the next coil spring cannot be done until the compressing plate is raised up.

In addition, since the coil springs thus formed are all the same in resiliency (rigidity), when rows of cased coil springs are linked to form a mat or equivalent, the resultant mat or equivalent cannot have a partially different resiliency.

To solve these problems, the applicant previously proposed a pocket coil spring producing apparatus (US Patent Publication No. 5,740,597, corresponding to the Japanese Laid-open Patent Publication No. Hei 9(1997)-173673). The proposed apparatus has, however, the disadvantage that when the production speed of the pocket coil spring producing apparatus is increased to increase productivity, the coil spring producing mechanism tend to produce errors in cutting of the wire. It also has undesirable tendencies of delays in hardening, conveying, compression, and insertion of the coil springs formed in the coil spring producing mechanism. In addition, mistakes in the process of laying down the coil springs as compressed vertically in the sheet casings or bags to their horizontal position are common.

SUMMARY OF THE INVENTION

The present invention has been made based on the applicant's previous proposal, with the aim to provide improved productivity and provide a high-grade mattress or equivalent having a partially different resiliency.

To accomplish the above objects with efficiency, a cased coil spring producing apparatus according to the invention comprises: a coil spring producing mechanism for forming coil springs; a conveying mechanism including a conveyer for conveying the coil springs fed from the coil spring producing mechanism; a hardening-and-cooling mechanism for hardening the coil springs and cooling them; a sheet feeding mechanism for double folding a sheet and feeding it; a compression-and insertion mechanism for compressing the coil springs and inserting them in the double folded sheet; a bonding mechanism for bonding the double folded sheet having therein the coil springs; and a coil spring arraying mechanism for changing the position of the coil springs inserted in the sheet.

It is preferable that the conveyer of the conveying mechanism includes coil spring supporting members aligned in two or more rows rising upwardly therefrom. A sorting mechanism is also provided for sortably distributing the coil springs fed from the coil spring producing mechanism to the coil spring supporting members.

Preferably, the coil spring producing mechanism comprises a device capable of changing a pitch of each of the coil springs formed in the process of forming the coil springs.

It is also preferable that the coil spring producing mechanism includes a cutter for cutting a wire of the springs successively formed into a coil form. The cutter has a cutting edge and a separation pawl for separating a terminal end of an earlier coil spring from a leading end of the next coil spring before the cutter edge goes into action. The cutter is structured so as to be movable between an operating position of the separation pawl and an operating position of the cutting edge.

Preferably, the coil spring producing mechanism is structured so that the coil springs can be changed in pitch by a wire guide member being changed in position while a terminal end of an earlier coil spring is separated from a leading end of the next coil spring and/or while a wire is formed into a coil form.

Further, it is preferable that the compression-and-insertion mechanism comprises a compressing member for compressing each row of coil springs by pressing from above; a driving mechanism for driving the compressing member for the pressing of the coil springs; and a carrying member for carrying the compressed coil springs to a shoot guide.

Desirably, the coil spring arraying mechanism is composed of rotating blades which slant the compressed coil springs in the sheets by pushing the coil springs at the upper portions thereof and which lay the slanted coil springs down to a horizontal position to array the coil springs in order.

It is preferable that the sheet feeding mechanism is so structured that at a sheet fold-back portion at which the sheet fed from a sheet roll is folded back or in proximity to the sheet fold-back portion, the sheet is folded to approximately half of the width of the sheet at a first folding portion. This folded part of the sheet is folded at a second folding portion at an angle of generally 90 degrees with respect to the first folding portion so that the folded part can be laid over or under the part of the sheet folded at the fold-back portion.

DETAILED DESCRIPTION OF THE PREFERRED EMBODIMENT

Referring now to the accompanying drawings, an example of the preferred embodiment of the present invention directed to a cased coil spring producing apparatus will be described below. It is to be understood, however, that the scope of the invention is by no means limited to the illustrated embodiment.

Figure 1:
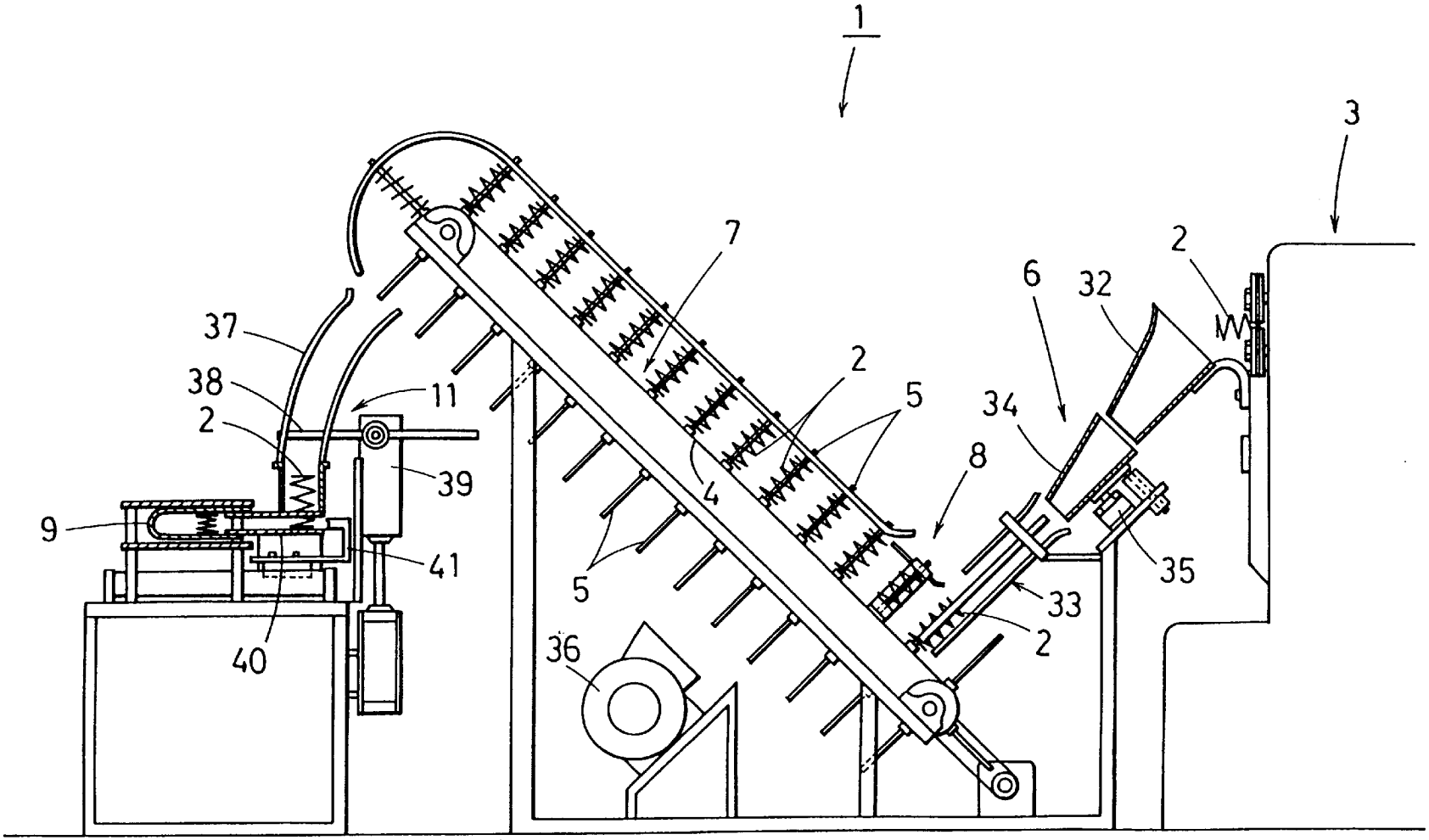
FIG. 1 is a side view of the whole spring producing mechanism of a cased coil spring producing apparatus according to the invention.
Figure 2:
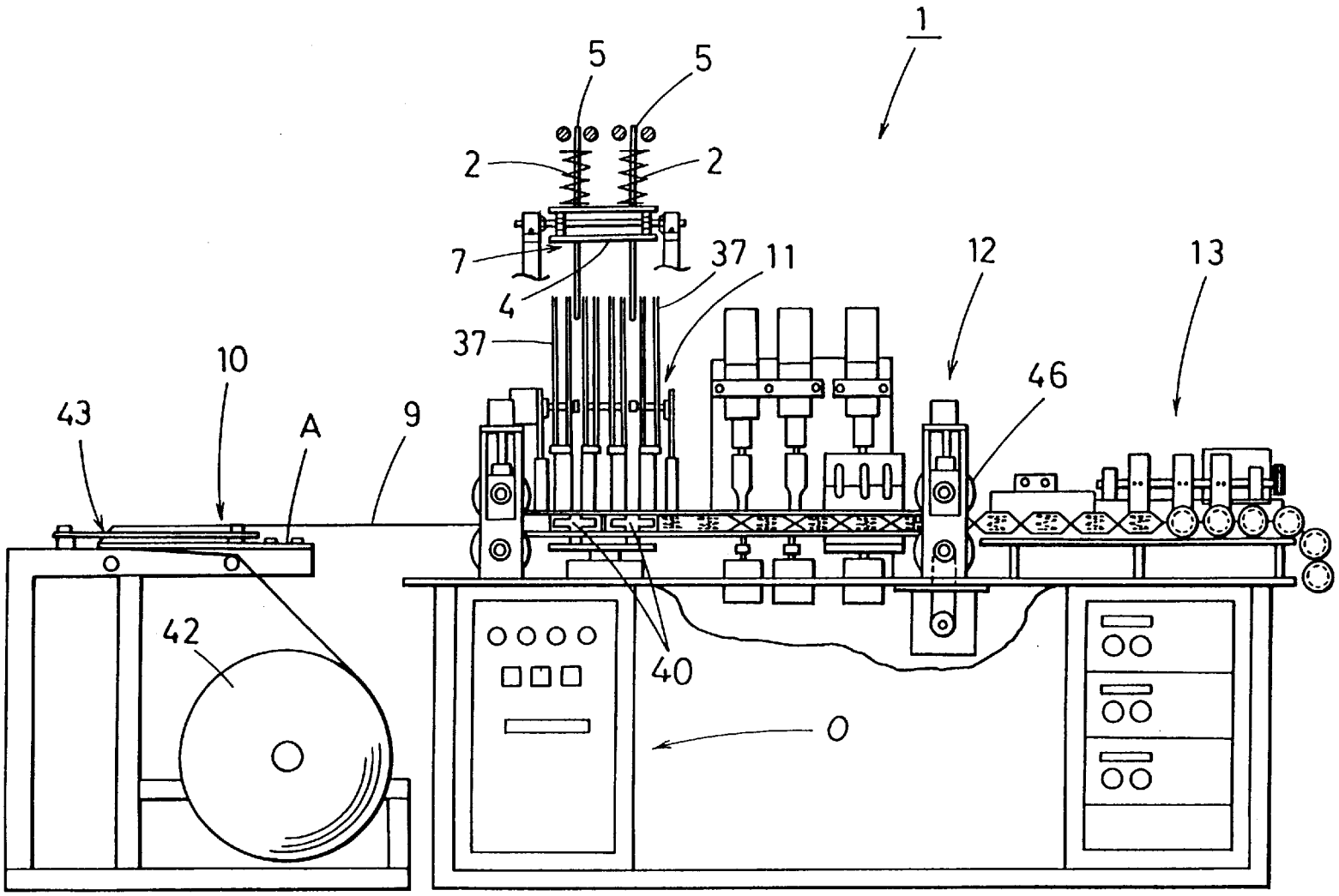
FIG. 2 is a schematic front view of the cased coil spring producing apparatus according to the invention.

FIG. 1 is a schematic side view of a cased coil spring producing apparatus, and FIG. 2 is a front view of the same. Numeral 1 in the illustration shows the entirety of the cased coil spring producing apparatus.

The cased coil spring producing apparatus 1 comprises a coil spring producing mechanism 3 for forming coil springs 2 from a wire; a coil spring sorting mechanism 6 for alternately distributing the coil springs 3 fed from the coil spring producing mechanism 3 to coil spring supporting bars 5 arranged in two rows on a conveyer 4; a conveying mechanism 7 including the conveyer 4 for conveying the coil springs 2 fed from the coil spring sorting mechanism 6 and supported by the supporting bars 5; a hardening-and-cooling mechanism 8 for successively hardening the coil springs 2 and cooling them by blowing in the process of conveyance; a sheet feeding mechanism 10 for feeding a double folded sheet 9 in which the coil springs are inserted; a compression-and-insertion mechanism 11 for simultaneously compressing a plurality of coil springs 2 as hardened and cooled and inserting them in the double folded sheet 9; a bonding mechanism 12 for bonding together the double folded sheet 9 having therein the coil springs 2, to form generally rectangular sheet casings or bags for casing therein the coil springs 2; a coil spring arraying mechanism 13 via which the coil springs 2 compressed vertically in the sheet bags are laid down in a longitudinal direction of the casings so that the coil springs can be presented in an array and be freed from the compression; and a control mechanism 0 for controlling each of the mechanisms in association with each other.

The respective mechanisms will be explained with reference to the production process of the coil springs.

Figure 3:
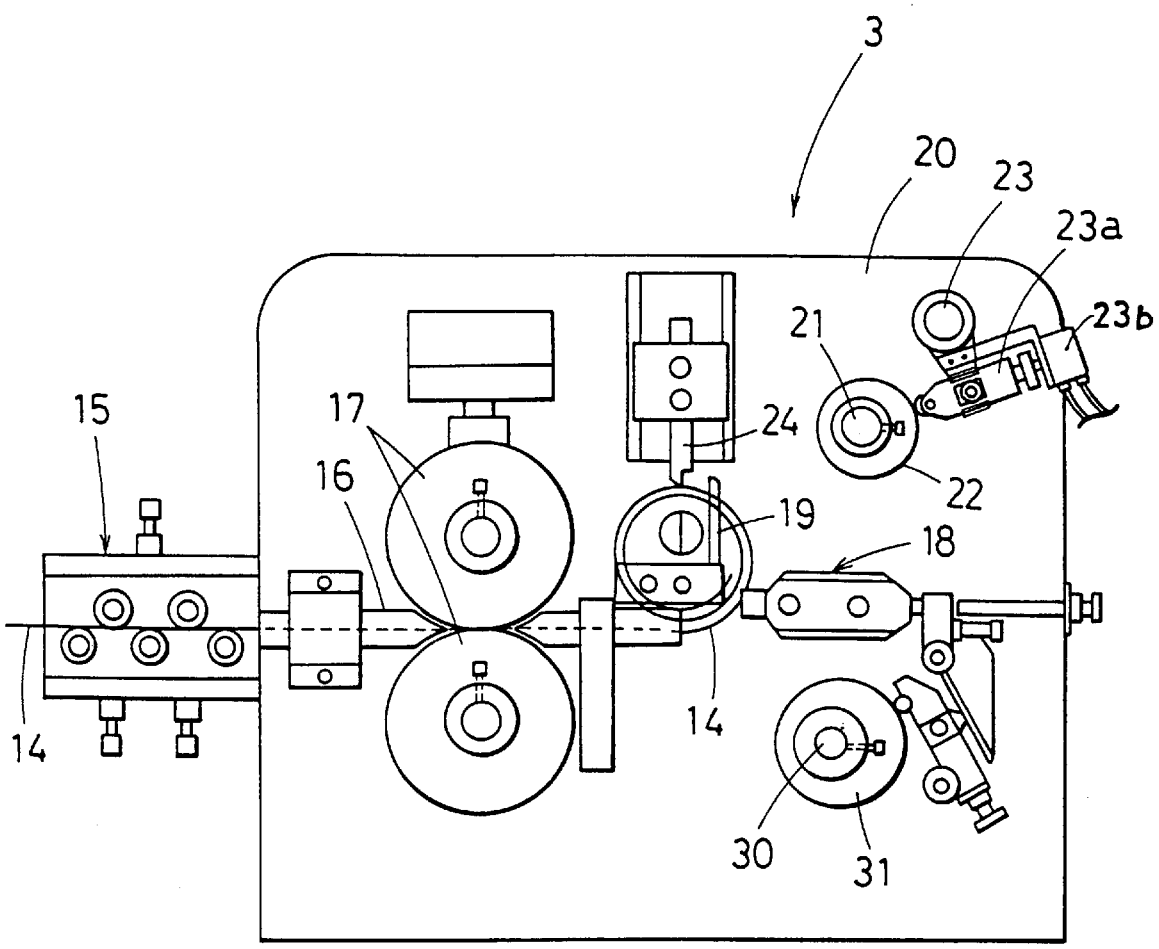
FIG. 3 is a front view of part of the spring producing mechanism of the cased coil spring producing apparatus according to the invention.

In the coil spring producing mechanism 3, as shown in FIG. 3, after a warp or distortion in a wire 14 fed from one side of the coil spring producing mechanism 3 is corrected by correcting means 15, the wire 14 is fed through a wire guide 16 to a round tool 18 via a pair of wire feed rollers 17, and is formed into a circular-arc form. Then, the wire 14 formed into the circular-arc form is pressed at one end thereof by a pitch tool 19, to be formed into a coil having a prescribed pitch. The pitch tool 19 also acts as a device for making changes in pitch and height of the coil springs.

The change in pitch of the coils thus successively formed is made by an operating shaft 23 being rotated by a pitch adjuster 23*a* which is shifted in sliding contact with a profile (a cam surface) of a pitch adjusting eccentric cam 22 which is assembled on a shaft 21 rotatably pivoted on a frame 20 of a part of the coil spring producing mechanism 3.

When the shaft 23 is rotated, the pitch tool 19 is swung back and forth (as viewed in FIG. 3) in association with the rotation of the shaft 23. This changes the pressing force of the pitch tool 19 against the wire 14.

Figure 4:
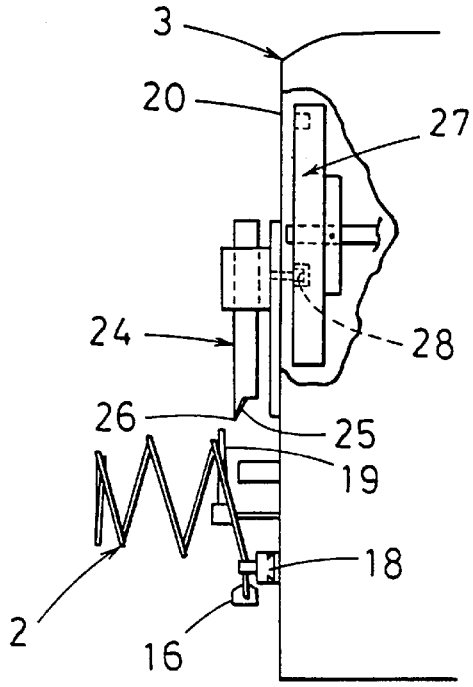
FIGS. 4–7 are schematic side views, each showing the process of forming the coil spring and the process of moving a movable cutter with a separation pawl in the coil spring producing mechanism according to the invention.
Figure 5:
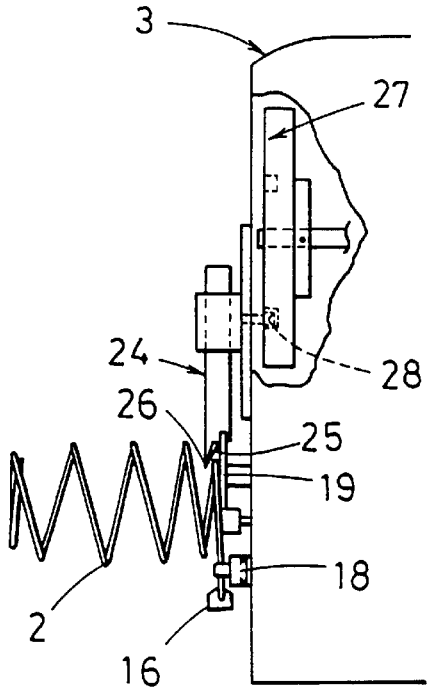
Figure 6:
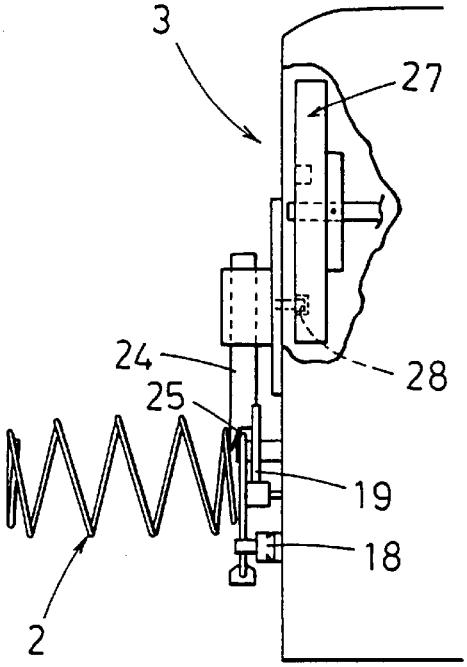
Figure 7:
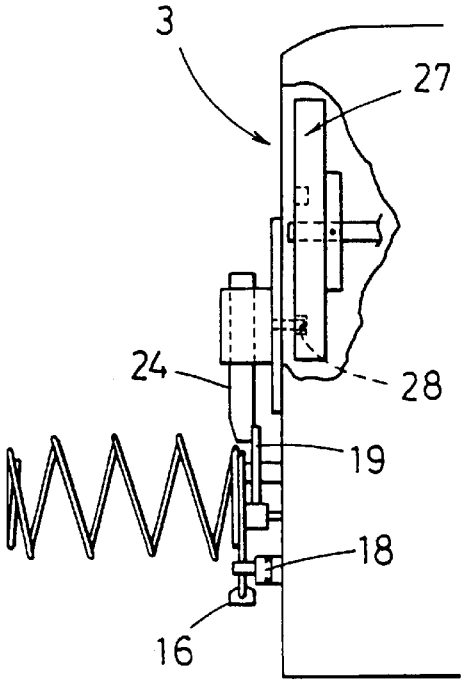

When the pressing force of the pitch tool 19 to the wire 14 is strong, the coil spring 2 will have a large pitch, as shown in FIG. 4, and when the pressing force is decreased, the coil spring 2 will have a small pitch or zero pitch, as shown in FIG. 5.

When the pressing force of the pitch tool 19 to the wire 14 is reduced to zero, the end of the coil spring 2 cut by a cutter 24 as will be mentioned later will be located inside of the coil spring.

The pitch of the coil springs can be variously changed by changing the position of the pitch adjuster 23*a* by a cylinder 23*b* in the course of producing the coil springs.

The round tool 18 is moved rightward or leftward in FIG. 3 in a swinging manner via an eccentric cam 31 which is assembled on a coil diameter adjusting shaft 30 pivoted on the frame 20 of a part of the coil spring producing mechanism 3.

When the round tool 18 is moved leftward, the coil spring 2 formed will have a reduced outer diameter; and when the round tool 18 is moved rightward, the coil spring 2 will have an increased outer diameter.

Thus, when the round tool 18 is successively moved during the manufacturing of the coil springs, the coil spring 2 of a barrel shape as shown in FIG. 5 or a hand-drum shape as opposed to the barrel shape, not shown, can be formed with ease.

The cutter 24 is disposed at an upper end portion of the coil spring 2 formed by the coil spring producing mechanism 3. The cutter 24 has a cutting edge 25 and an integrally formed separation pawl 26, located at the tip end portion of the cutter, for separating a terminal end of an earlier coil spring from a leading end of the next coil spring, as shown in FIGS. 4 to 8. The cutter is structured so as to be movable between an operating position of the separation pawl 26 and an operating position of the cutting edge 25.

A cutter operating cam 27 is provided in the frame at the side of the coil spring producing mechanism 3. When the cutter operating cam 27 is rotated, a cam slot 28 slotted in the cutter operating cam 27 controls the cutter 24 to move between a first position (at which the separation pawl 26 projects) and a second position (at which the separation pawl further projects) so that the cutting edge 25 cuts the wire of the coil spring 2.

Figure 8:
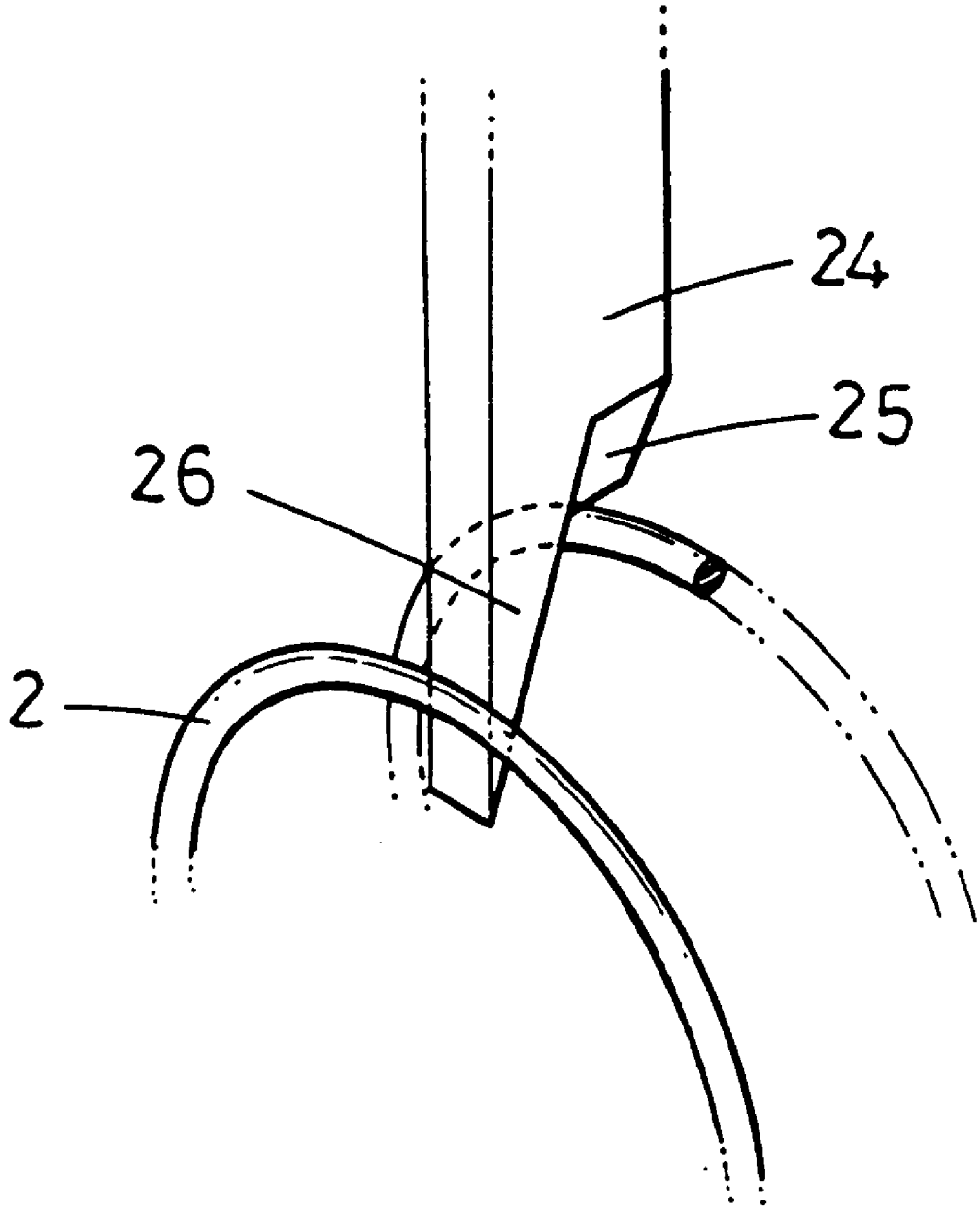
FIG. 8 is a perspective view of a working portion of the separation pawl of the coil spring producing mechanism according to the invention.

When the cutter 24 comes near to the terminal end portion of the coil spring 2, the cutter operating cam 27 is operated to insert the separation pawl 26 into a space between coils to expand the space between the coil and the adjoining wire to be cut (See FIG. 8). Thereupon, the pitch adjusting eccentric cam 22 is adjusted so that even when the pitch of the coil spring 2 is reduced to zero or less (i.e., even when the terminal end of the coil spring or a leading end of the next coil spring comes into the inside), or when the cutter 24 is moved further to bring the cutting edge 25 into action, the wire can be cut at a specified position without errors in cutting.

The coil springs 2 thus cut by use of the cutter 24 are fed from a shooter 32 opening in front of the cutter to the conveyer 4 of the conveying mechanism 7 through the sorting mechanism 6 and a feeding guide 33.

Figure 9:
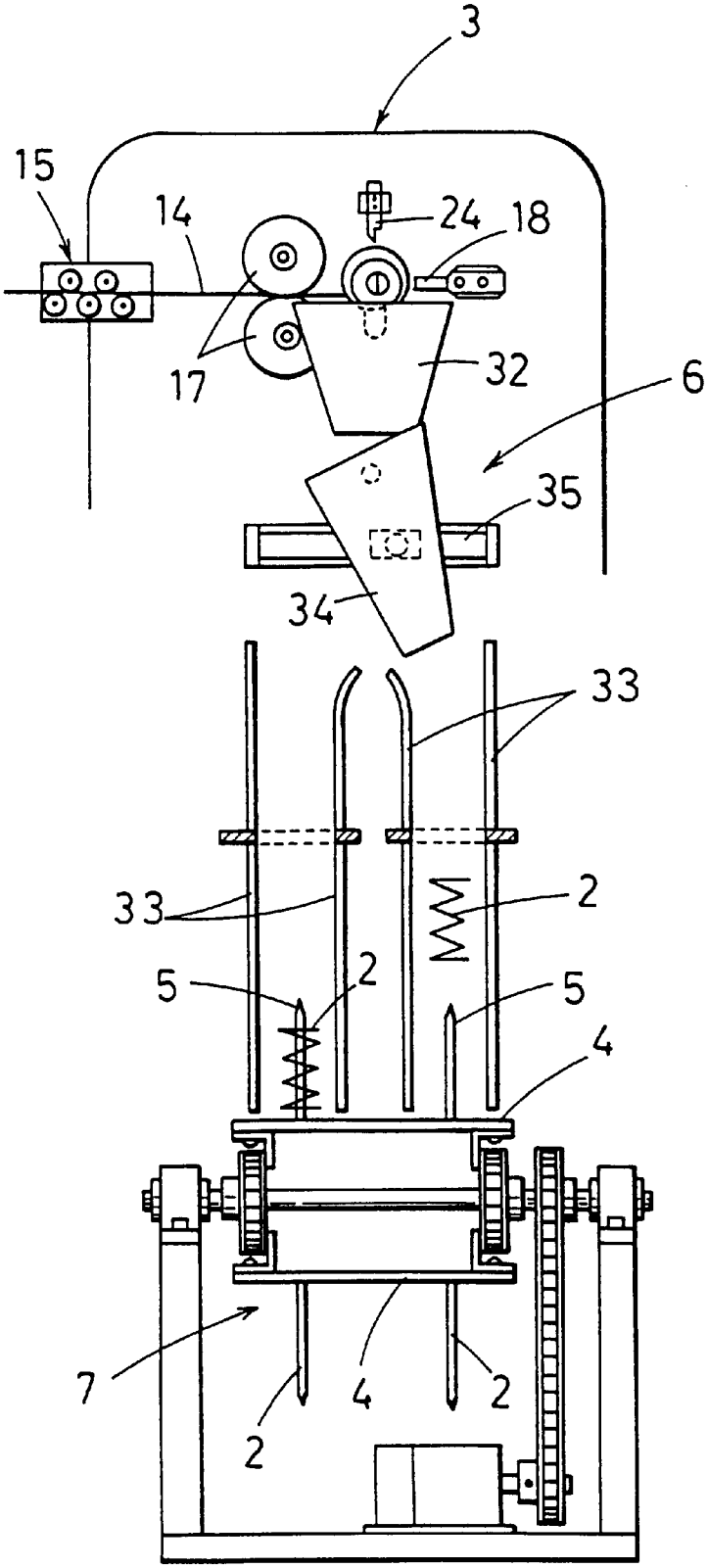
FIG. 9 is a front view of the sorting mechanism and conveying mechanism in the coil spring producing mechanism according to the invention.

The coil spring supporting bars 5, 5 in two rows are embedded in the conveyer 4 of the conveying mechanism 7. The sorting mechanism 6 for sortably distributing the coil springs 2, 2 to the two rows of coil spring supporting bars 5, 5 is provided between the shooter 32 and the feeding guide 33, as shown in FIG. 9. The sorting mechanism comprises a cylindrical guide portion 34 for guiding the coil springs.

The cylindrical guide portion 34 is rotatably pivoted nearly at an upper edge portion thereof, so that a lower portion of the cylindrical guide portion 34 is selectively swung between the two rows of coil spring supporting bars 5, 5 by a cylinder 35 provided under the pivot point of the cylindrical guide portion 34.

The hardening-and-cooling mechanism 8, via which the coil springs 2 fed to the conveyer 4 of the conveying mechanism 7 are hardened and cooled on their way to the compression-and-insertion mechanism 11, comprises electrodes and a blower 36. The electrodes are brought into contact with the coil springs 2 at upper and lower portions thereof, so as to pass a current through the coil springs 2 from the electrodes so that the coil springs can be heated and thus hardened. After being hardened, the coil springs 2 are cooled down to generally atmospheric temperature by the blower 36 which sends air to the coil springs 2. The coil springs 2 are then fed to the following compression-and mechanism 11.

The compression-and-insertion mechanism 11 comprises frame shooters 37 through which the coil springs supported by the coil spring supporting bars 5, 5 are fed when the conveyer 4 turns around at the upper turn and the coil spring supporting bars 5 point downward, as shown in FIG. 1. Plate-like compressing members 38 with which the coil springs 2 fed into the frame shooters 37 are pressed from above into a compressed form are provided. A driving mechanism 39 is attached to the compressing members for driving the compressing members 3 8 to rotate and move up and down. Shoot guides 40 having a cross section like the horizontally oriented letter U (FIG. 2) are provided at lower end portions of the frame shooters 37, and the compressed coil springs 2 are fitted at the side edge portions o the shoot guides. Hook carriages 41 via which the compressed coil springs 2 held at one end thereof by the shoot guides 40 are carried into the double folded sheets 9 fed from the sheet feeding mechanism 10.

Figure 10:
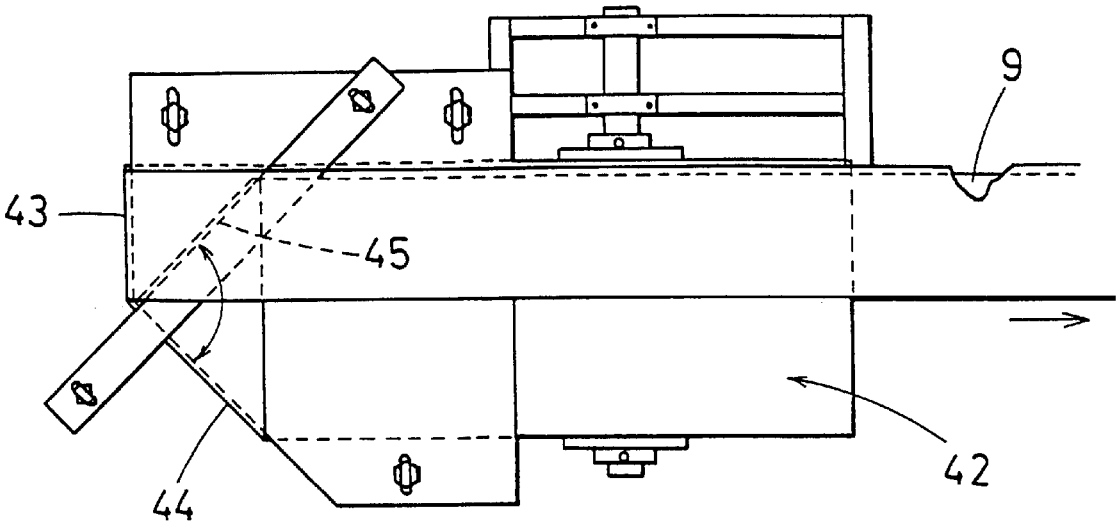
FIG. 10 is a plan view of a part of the sheet feeding mechanism according to the invention.

In the sheet feeding mechanism 10, the sheet 9 fed from a sheet roll 42 of a non-woven fabric in strip form is folded back at one end 43 (at the left side) of the cased coil spring producing apparatus 1, as shown in FIGS. 2 and 10. In proximity to the fold-back portion 43, the sheet 9 is first folded approximately half of the width of the sheet at a first folding portion 44 and further this folded part of the sheet is folded at a second folding portion 45 so that the part as folded twice can be laid over or under the part of the sheet folded at the fold-back portion 43. The angle formed between the first folding portion 44 and the second folding portion 45 is generally 90 degrees.

The doubled sheets 9 for inserting therein the compressed coil springs 2 are sealed at their parts at the side of the coil springs 2 and at their openings for insertion of the coil springs 2 by fusing or adhesive bonding via the bonding mechanism 12, with the coil springs kept compressed. The resultant sheet casings are fed to the coil spring arraying mechanism 13 through sheet feed rollers 46.

Figure 11:
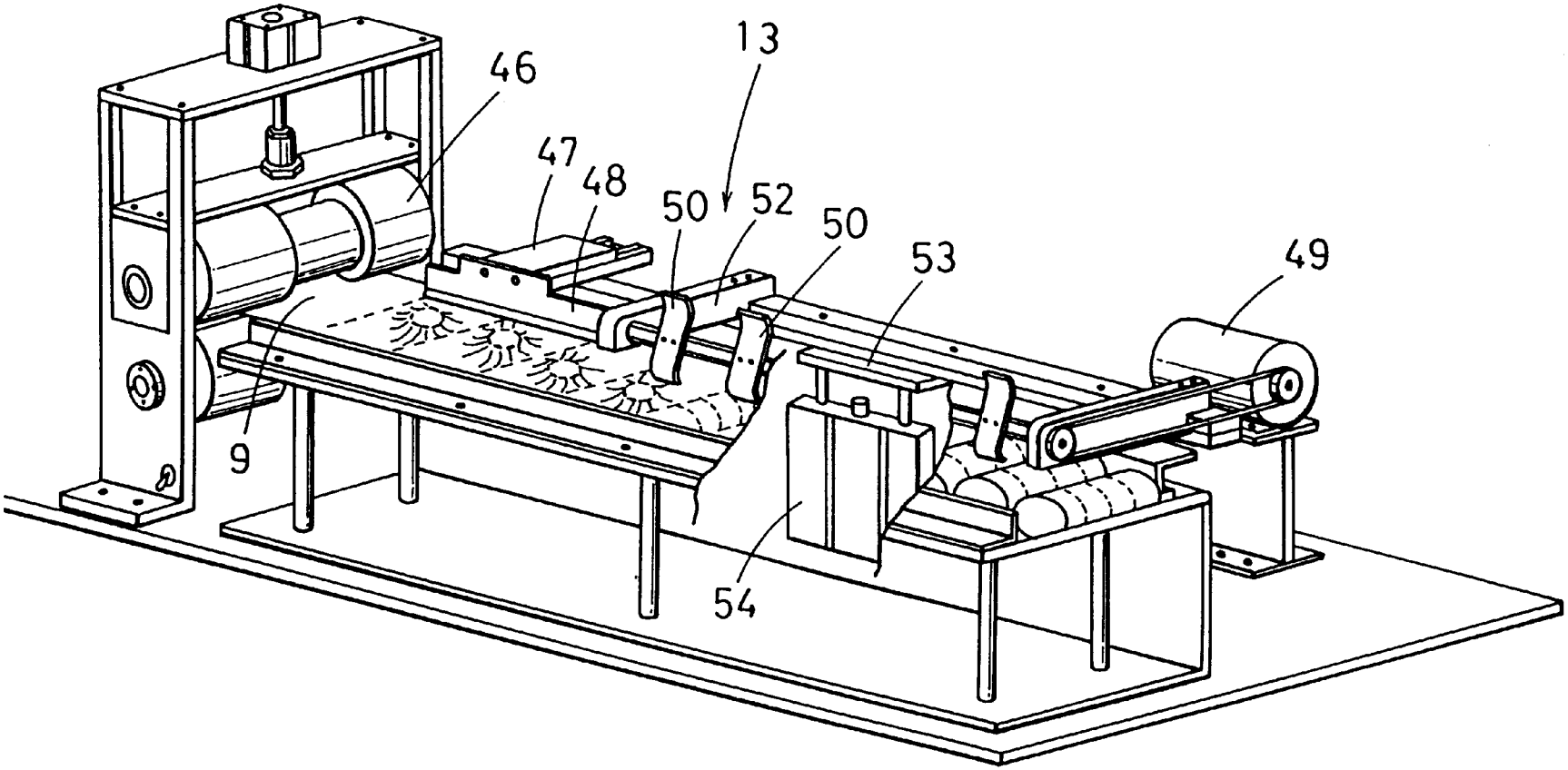
FIG. 11 is a partially cutaway perspective view of the coil spring arraying mechanism according to the invention.
Figure 12:
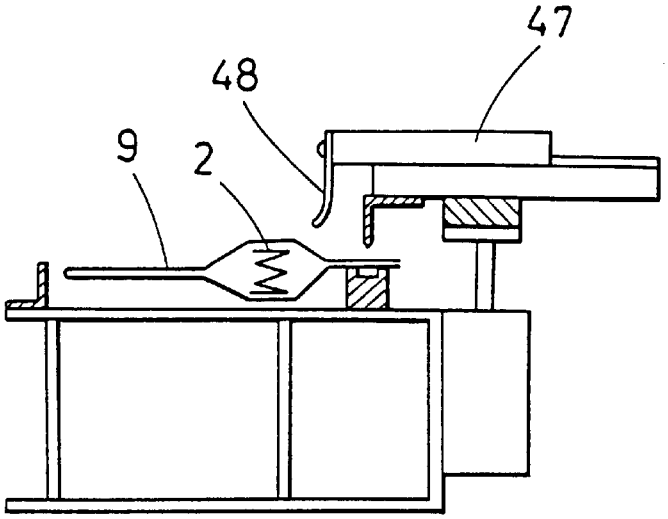
FIGS. 12 and 13 are sectional views of the coil spring arraying mechanism according to the invention, each showing the movement of the push-down plate and the change of the coil spring.
Figure 13:
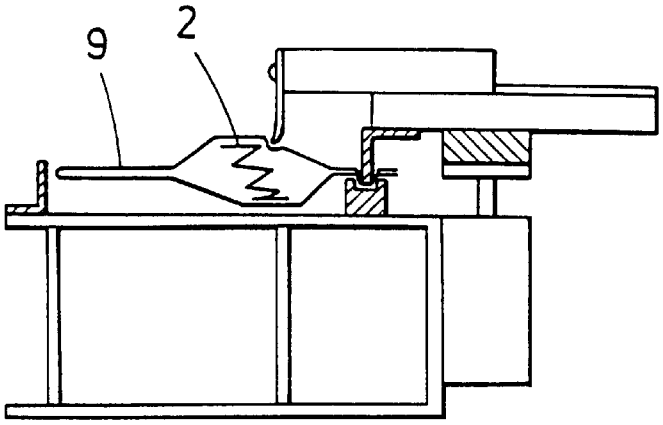
Figure 14:
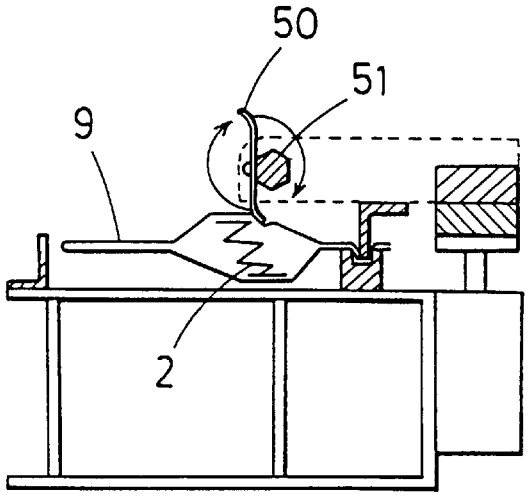
FIGS. 14 and 15 are sectional views of the coil spring arraying mechanism according to the invention, each showing the movement of the rotating blade and change of the coil spring.
Figure 15:
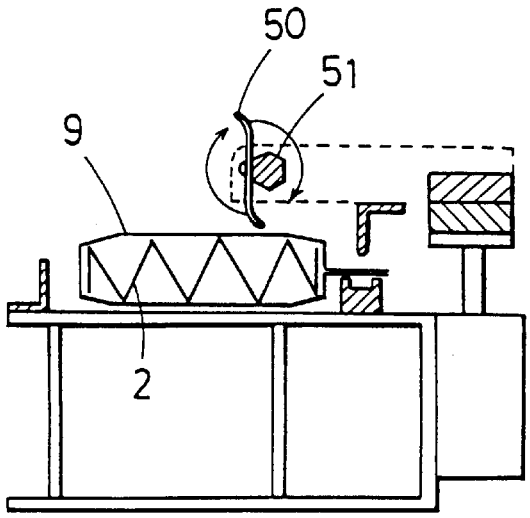

In the coil spring arraying mechanism 13, the coil springs 2, compressed so as to be in a vertical position in the sheet casings fed through the sheet feed rollers 46, are pushed at their upper end portions by a push-down plate 48 fixed to an air cylinder 47, as shown in FIGS. 2, 11 and 12, and are thereby slanted, as shown in FIG. 13. Thereafter, in the step shown in FIG. 14, the slanted coil springs 2 are tapped at their upper end portions by rotating blades 50 rotated by a motor 49 to be fallen out so that the axes of the coil springs 2 can be oriented horizontally (See FIGS. 14 and 15).

The air cylinder 47, for actuating the push-down plate 48, and the bearings 52 of rotary shaft 51 of the rotating blades 50 are fixed to a fixing plate 53, and the fixing plate 53 is fixed to an elevating air cylinder 54. While the products are fed forward by the sheet feeding rollers 46, the push-down plate 48 and the rotating blades 50 are put in their raised position by the elevating air cylinder 54 so as not to hinder the feeding of the products (See FIG. 10).

The cased coil springs 2 thus formed are aligned in row, and a number of cased coil springs in row can be bonded to each other at the side wall portions thereof by application of adhesive to thereby produce a spring structure for a bed, for example.

What is claimed is:

1. A cased coil spring producing apparatus comprising:

a coil spring forming mechanism for forming coil springs, said coil spring forming mechanism including a cutter for cutting a wire of each of the coil springs, said cutter including a cutting edge and a separation pawl for separating a terminal end of a first coil spring from a leading end of a second coil spring before said cutting edge cuts the wire, said cutter being capable of movement between a cutting edge operating position and a separation pawl operating position;

a conveying mechanism including a conveyor for conveying the coil springs formed by said forming mechanism;

a hardening-and-cooling mechanism for hardening and cooling the coil springs formed by said forming mechanism;

a sheet feeding mechanism for double-folding and feeding a sheet;

a compression-and-insertion mechanism for compressing and inserting the coil springs into the double-folded sheet fed by said sheet feeding mechanism;

a bonding mechanism for bonding together edges of the double-folded sheet having the coil springs inserted therein; and a coil spring arraying mechanism for changing a position of each of the coil springs inserted in the double-folded sheet.

2. The apparatus of claim 1, wherein said conveyor of said conveying mechanism includes coil spring supporting members aligned in at least two rows and extending upwardly from said conveyor, further comprising a sorting mechanism for distributing the coil springs formed by said coil spring forming mechanism to said coil spring supporting members.

3. The apparatus of claim 2, wherein said compression-and-insertion mechanism includes a compressing member for pressing down on each of the coil springs so as to compress each of the coil springs, a driving member for driving said compressing member, and a carrying member for carrying each of the compressed coil springs to a shoot guide.

4. The apparatus of claim 2, wherein said coil spring forming mechanism includes a pitch tool for changing a pitch of each of the coil springs.

5. The apparatus of claim 4, wherein said pitch tool comprises a wire-pressing member capable of changing position while wire is formed into a coil by said coil spring forming mechanism.

6. The apparatus of claim 1, wherein said coil spring forming mechanism includes a pitch tool for changing a pitch of each of the coil springs.

7. The apparatus of claim 6, wherein said pitch tool comprises a wire-pressing member capable of changing position while wire is formed into a coil spring by said coil spring forming mechanism.

8. The apparatus of claim 1, wherein said compression-and-insertion mechanism includes a compression member for pressing down on each of the coil springs so as to compress each of the coil springs, a driving member for driving said compression member, and a carrying member for carrying each of the compressed coil springs to a shoot guide.

9. A cased coil spring producing apparatus comprising:

a coil spring forming mechanism for forming coil springs;

a conveying mechanism including a conveyor for conveying the coil springs formed by said forming mechanism;

a hardening-and-cooling mechanism for hardening and cooling the coil springs formed by said forming mechanism;

a sheet feeding mechanism for double-folding and feeding a sheet;

a compression-and-insertion mechanism for compressing and inserting the coil springs into the double-folded sheet fed by said sheet feeding mechanism;

a bonding mechanism for bonding together edges of the double-folded sheet having the coil springs inserted therein; and a coil spring arraying mechanism for changing a position of each of the coil springs inserted in the double-folded sheet, said coil spring arraying mechanism including rotating blades for pushing an upper portion of each of the coil springs so as to reposition each of the coil springs from a vertical position to a horizontal position relative to the double-folded sheet.

10. The apparatus of claim 9, wherein said conveyor of said conveying mechanism includes coil spring supporting members aligned in at least two rows and extending upwardly from said conveyor, further comprising a sorting mechanism for distributing the coil springs formed by said coil spring forming mechanism to said coil spring supporting members.

11. The apparatus of claim 10, wherein said compression-and-insertion mechanism includes a compressing member for pressing down on each of the coil springs so as to compress each of the coil springs, a driving member for driving said compressing member, and a carrying member for carrying each of the compressed coil springs to a shoot guide.

12. The apparatus of claim 10, wherein said coil spring forming mechanism includes a pitch tool for changing a pitch of each of the coil springs.

13. The apparatus of claim 12, wherein said pitch tool comprises a wire-pressing member capable of changing position while wire is formed into a coil spring by said coil spring forming mechanism.

14. The apparatus of claim 9, wherein said coil spring forming mechanism includes a pitch tool for changing a pitch of each of the coil springs.

15. The apparatus of claim 14, wherein said pitch tool comprises a wire-pressing member capable of changing position while wire is formed into a coil spring by said coil spring forming mechanism.

16. The apparatus of claim 9, wherein said compression-and-insertion mechanism includes a compression member for pressing down on each of the coil springs so as to compress each of the coil springs, a driving member for driving said compression member, and a carrying member for carrying each of the compressed coil springs to a shoot guide.

17. A cased coil spring producing apparatus comprising:

a coil spring forming mechanism for forming coil springs;

a conveying mechanism including a conveyor for conveying the coil springs formed by said forming mechanism;

a hardening-and-cooling mechanism for hardening and cooling the coil springs formed by said forming mechanism;

a sheet feeding mechanism for double-folding and feeding a sheet, said sheet feeding mechanism including a fold-back portion, a first folding portion, and a second folding portion arranged at an angle of 90 degrees to said first folding portion, wherein a first half of the sheet is folded at the first folding portion and at the second folding portion so as to be laid over a second half of the sheet folded over said fold-back portion;

a compression-and-insertion mechanism for compressing and inserting the coil springs into the double-folded sheet fed by said sheet feeding mechanism;

a bonding mechanism for bonding together edges of the double-folded sheet having the coil springs inserted therein; and a coil spring arraying mechanism for changing a position of each of the coil springs inserted in the double-folded sheet.

18. The apparatus of claim 17, wherein said conveyor of said conveying mechanism includes coil spring supporting members aligned in at least two rows and extending upwardly from said conveyor, further comprising a sorting mechanism for distributing the coil springs formed by said coil spring forming mechanism to said coil spring supporting members.

19. The apparatus of claim 18, wherein said compression-and-insertion mechanism includes a compressing member for pressing down on each of the coil springs so as to compress each of the coil springs, a driving member for driving said compressing member, and a carrying member for carrying each of the compressed coil springs to a shoot guide.

20. The apparatus of claim 18, wherein said coil spring forming mechanism includes a pitch tool for changing a pitch of each of the coil springs.

21. The apparatus of claim 20, wherein said pitch tool comprises a wire-pressing member capable of changing position while wire is formed into a coil spring by said coil spring forming mechanism.

22. The apparatus of claim 17, wherein said coil spring forming mechanism includes a pitch tool for changing a pitch of each of the coil springs.

23. The apparatus of claim 22, wherein said pitch tool comprises a wire-pressing member capable of changing position while wire is formed into a coil spring by said coil spring forming mechanism.

24. The apparatus of claim 17, wherein said compression-and-insertion mechanism includes a compression member for pressing down on each of the coil springs so as to compress each of the coil springs, a driving member for driving said compression member, and a carrying member for carrying each of the compressed coil springs to a shoot guide.

* * * * *